US008113914B2

(12) United States Patent
Ohashi et al.

(10) Patent No.: US 8,113,914 B2
(45) Date of Patent: Feb. 14, 2012

(54) TREATING METHOD FOR BRITTLE MEMBER

(75) Inventors: Hitoshi Ohashi, Saitama (JP); Naofumi Izumi, Tokyo (JP)

(73) Assignee: LINTEC Corporation, Tokyo (JP)

( * ) Notice: Subject to any disclaimer, the term of this patent is extended or adjusted under 35 U.S.C. 154(b) by 835 days.

(21) Appl. No.: 12/134,978

(22) Filed: Jun. 6, 2008

(65) Prior Publication Data

US 2008/0305721 A1 Dec. 11, 2008

(30) Foreign Application Priority Data

Jun. 8, 2007 (JP) ..... 2007-152857

(51) Int. Cl.
*B24B 1/00* (2006.01)

(52) U.S. Cl. ..... 451/41; 451/54; 451/63; 451/364; 156/247; 438/458; 438/459

(58) Field of Classification Search ..... 451/41, 451/54, 63, 285, 287, 364; 156/236, 247; 438/458, 459; 428/343
See application file for complete search history.

(56) References Cited

U.S. PATENT DOCUMENTS

| | | | | |
|---|---|---|---|---|
| 6,854,386 | B2 * | 2/2005 | Geddes et al. | 101/33 |
| 7,326,313 | B2 * | 2/2008 | Lee et al. | 156/236 |
| 7,531,206 | B2 * | 5/2009 | Lee et al. | 427/77 |
| 2004/0248382 | A1 * | 12/2004 | Hatai et al. | 438/460 |
| 2006/0246640 | A1 * | 11/2006 | Kuwashima et al. | 438/151 |
| 2010/0173473 | A1 * | 7/2010 | Jinbo et al. | 438/458 |

FOREIGN PATENT DOCUMENTS

| | | |
|---|---|---|
| JP | 2005-243780 | 9/2005 |
| JP | 2006-216844 | 8/2006 |
| JP | 2006-310699 | 11/2006 |

* cited by examiner

*Primary Examiner* — Eileen P. Morgan
(74) *Attorney, Agent, or Firm* — Hahn & Voight PLLC; Roger C. Hahn

(57) ABSTRACT

An object of the present invention is to provide a treating method for brittle member capable of stably holding the brittle member when applying predetermined treatments such as transportation and grinding back surface of a brittle member such as a semi-conductor wafer and separating the brittle member without breakage after finishing required treatment to thereby attaining high thickness accuracy of the brittle member.

A treating method for brittle member comprising: a step of removably fixing a brittle member on a flexible glass base plate, a step of treating said brittle member, a step of fixing said brittle member side by holding means, and a step of separating said flexible glass base plate from said brittle member by bending said flexible glass base plate.

21 Claims, 7 Drawing Sheets

TREATING METHOD FOR BRITTLE MEMBER

FIELD OF THE INVENTION

The present invention relates to a treating method for a brittle member when applying desired processing such as transportation and grinding back surface of a brittle member such as a semi-conductor wafer.

DESCRIPTION OF THE RELATED ART

According to popularization of IC Card in recent years, reducing the thickness of a semi-conductor wafer which is constitutional member for manufacturing IC chip progresses. It being required that a thickness of the wafer which is conventionally 350 μm and the like is to make thinner as 50 to 100 μm or less.

As the wafer which is a brittle member becomes thinner, possibilities of breakage becomes higher when processing or transporting. Therefore, in case that grinding the wafer until ultra thin and transporting the ultra thin wafer, it is preferable to proceed operation thereof with fixing and protecting the wafer on a hard plate such as a glass plate or acrylic plate by a double-sided adhesive sheet and the like.

However, according to a method for laminating the wafer and the hard plate by the double-sided adhesive sheet, wafer is broken at sometimes, when separating both members after finishing a series of process. When separating multilayer member composed of two sheets of thin layer member, it is necessary to curve or bend (hereinafter referred to as "bend") one of the thin layer member or both members for separating. However, since it is impossible or very hard to bend the hard plate, the wafer side has to be curved inevitably. Therefore, the wafer is broken since strain is loaded to the wafer which is brittle.

As means for solving these problems, variety of methods are proposed which are a method for operating separation by reducing deformation of the wafer as much as possible, a method for operating separation after the wafer is reinforced by laminating a protection film to the wafer and the like, further as means for fixing the wafer to the hard plate, a method for separation wherein an adhesive agent or double-sided adhesive tape capable of controlling adhesive force is used as means for fixing the wafer, and reducing adhesive force by suitable means such as foaming adhesive agent to thereby separating (Patent Documents 1 to 5).

Patent Document 6 discloses a method for protecting brittle member by using a resin film having relatively high rigidity without using the hard plate.

Patent Document 7 discloses a support plate for a semi-conductor wafer having 0.5 to 3 mm thickness and the thickness tolerance within 2 μm. As a fixing means for the semi-conductor, a double-sided adhesive tape which generates gas by ultra-violet ray irradiation is exemplified.

[Patent Document 1] Japanese Patent Application Laid Open No. 2004-153227

[Patent Document 2] Japanese Patent Application Laid Open No. 2005-116678

[Patent Document 3] Japanese Patent Application Laid Open No. 2003-324142

[Patent Document 4] Japanese Patent Application Laid Open No. 2005-277037

[Patent Document 5] International Patent Application Laid Open No. WO2003/049164

[Patent Document 6] Japanese Patent Application Laid Open No. 2004-63678

[Patent Document 7] Japanese Patent Application Laid Open No. 2005-333100

DISCLOSURE OF THE INVENTION

Problems to be Solved by the Invention

In case that a wafer is hold on a hard plate, a wafer side is deformed when separates the wafer. Thus, it is difficult to prevent breakage of the wafer completely. Also, in case that a specific adhesive agent or a double-sided adhesive tape designed for reducing adhesive force by foaming and the like is used, there will be possibility that the wafer is contaminated because adhesive agent remains on the wafer. In methods proposed in Patent Document 6 and Patent Document 7, because separation from the wafer is conducted by deforming a rigid resin film or a resin plate side, a problem of breakage of the wafer is solved at separation process. However, since a holding member is composed of a resin, there is risk of breakage of the wafer when transporting the wafer, since a shape retaining is not necessarily sufficient. Also, a resin film or a resin plate cannot be used repeatedly, because heat deformation thereof often occurs due to a low heat resistance and plastic deformation occurs at a normal temperature. Further, it is difficult to reduce a thickness inaccuracy, sometimes the thickness inaccuracy influences on an accuracy of the processed wafer.

The present invention attempts to solve the problems associated with the above mentioned conventional art. Namely, an object of the present invention is to provide a treating method for brittle member, capable of stably holding the brittle member when applying predetermined treatments such as transportation and grinding back surface of a brittle member such as a semi-conductor wafer and separating the brittle member without breakage after finishing required treatment to thereby attaining high thickness accuracy of the brittle member.

Means for Solving the Problem

Gist of the present invention aims for solving these problems is as follows;

(1) A treating method for brittle member comprising:

a step of removably fixing a brittle member on a flexible glass base plate, a step of treating said brittle member, a step of fixing said brittle member side by holding means, and, a step of separating said flexible glass base plate from said brittle member by bending said flexible glass base plate.

(2) The treating method as set forth in (1), wherein an outer diameter of said flexible glass plate is an identical with or larger than an outer diameter of said brittle member.

(3) The treating method as set forth in (1), wherein said flexible glass plate curves at an angle of 30 degree or more.

(4) The treating method as set forth in (1), wherein said separating process comprises gripping end portion of said flexible glass base plate, lifting up said end portion from said brittle member, and moving towards a turning direction of said flexible glass base plate.

(5) The treating method as set forth in (1), wherein said separating process comprising, applying a first adhesive sheet tightly tensioned on a first ring frame to said brittle member, applying a second adhesive sheet tightly tensioned on a second ring frame to said flexible glass base plate, fixing a first adhesive sheet side on a suction table, enlarging the space between said first ring frame and said second ring frame to thereby separating the brittle glass plate from a surface of the brittle member by bending the flexible glass base plate applied on the second adhesive sheet.

(6) The treating method as set forth in any one of (1) to (5) wherein, said brittle member is a semi-conductor wafer.

(7) The treating method as set forth in (6), wherein a treatment applied to the brittle member is a grinding back surface of the semi-conductor wafer.

Effects of the Invention

In the present invention, because of protecting a brittle member fixed on a flexible glass plate, the brittle member can be held without deformation when transporting, storing, processing the brittle member, a high thickness accuracy treatment of the brittle member can be applied. Also, as it is different from a conventionally used rigid glass plate, breakage of the brittle member can be prevented without deformation of the brittle member when separating the flexible glass base plate from the brittle member, since a flexible glass base plate can be curved or bent.

BEST MODE FOR CARRYING OUT THE INVENTION

Figure 1:
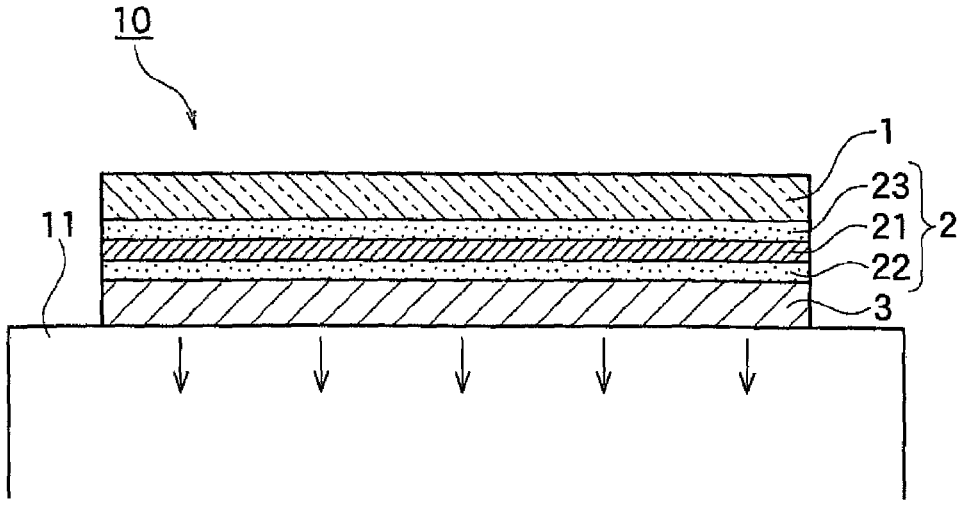
FIG. 1 shows one process for a treating method of a brittle member of the present invention.

Hereinafter, the present invention will be explained specifically, with reference to drawings.

In a treating method of the present invention, a brittle member 3 is removably fixed on a flexible glass base plate 1 via a temporary adhesive means 2 to form a structure body 10 which protects the brittle member 3.

As the brittle member 3 which is an object of protection, although it is exemplified that a workpiece composed of easily breakable material such as various semi-conductor wafers such as a silicon wafer, a gallium arsenide wafer, an optical glass, ceramic plate and the like to which precision processing is required, it is not limited thereof. In these, it is preferable to apply the semi-conductor wafer. Specifically, it is particularly preferable to apply the semi-conductor wafer wherein circuits are formed on a front surface. Further, the treating method of the present invention can be preferably applied to a semi-conductor wafer having been subjected to grinding back surface to be extremely thin thickness and a hardness thereof is extremely reduced.

The flexible glass base plate 1 has function of holding and protecting the above mentioned brittle member 3 when transporting, storing and processing the brittle member 3. When separating the flexible glass base plate 1 from the brittle member 3, the separation is conducted with deforming and bending the flexible glass base plate 1 side. For this reason, it is particularly preferable that the flexible glass plate 1 has an adequate bending property.

Specifically, it is preferable the flexible glass base plate 1 preferably curves at an angle of 30 degree or more, more preferably 40 degree or more and particularly preferably 50 degree or more when it is bent. Namely, the maximum curving angle of the flexible glass base plate 1 is 30 degree or more. The maximum curving angle is defined by an angle of tangent of the maximum bending immediately before breaking when holding one end of the flexible glass base plate and the other end is bent toward a returning direction of the base plate. When the maximum curving angle is too small, a breakdown point is achieved during the flexible glass plate bending, and thus, there is a risk for break of the flexible glass plate 1 and the brittle member 3.

Although material of the flexible plate 1 is not particularly limited, as a material which fulfills the above mentioned preferable bending property, for example, chemically reinforced glass described in Japanese Patent Application Laid Open No. H05-32431 is exemplified. Specifically, such chemically reinforced glass can be obtained by subjecting a glass which comprises 62 to 75 wt % of $SiO_2$, 5 to 15 wt % of $Al_2O_3$, 4 to 10 wt % of $Li_2O$, 4 to 12 wt % of $Na_2O$ and 5.5 to 15 wt % of $ZrO_2$, and having weight ratio of $Na_2O/ZrO_2$ of 5 to 2.0, weight ratio of $Al_2O_3/ZrO_2$ of 0.4 to 2.5 (herein after referred as "material glass") to chemical strengthening by ion exchange process with treating the material glass in a processing bath comprising Na ion and/or K ion.

As the processing bath comprising Na ion and/or K ion, it is preferable to use a processing bath comprising sodium nitrate and/or potassium nitrate, however, it is not limited to nitrate. Sulfate, bisulfate, carbonate, bicarbonate and halide may be used. In case that the processing bath comprises Na ion, this Na ion exchanges with Li ion in the glass, in case that the processing bath comprises K ion, this K ion exchanges with Na ion in the glass, further in case that the processing bath comprises Na ion and K ion, these Na ion and K ion exchange with Li ion and Na ion in the glass, respectively. By this ion-exchanging, alkali metal ion of a glass surface part is replaced with other alkali metal ion having larger ion radius, and the glass is chemically strengthened, since compression stress layer is formed on the glass surface part. Since the material glass has an excellent ion-exchange performance, the compression stress layer formed by the ion-exchanging is deep, the obtainable chemically strengthened glass has an excellent fracture resistance, since a deflective intensity is high. The depth of the compression stress layer is measured by means, for example, a polarizing microscope observation of a glass cross section and the like.

The chemically reinforced glass has the above mentioned bending property, and shows flexibility having no breakage even it is bent. Also, when removing stress after bending, a shape is restored immediately.

Though the thickness of the flexible glass base plate 1 is not particularly limited, 300 to 1500 μm and so on is appropriate. When the thickness of the flexible glass base plate 1 is too thin, a sufficient strength for holding the brittle member may not be obtained, and when the thickness is too thick, the flexible glass base plate may not be bent at a separating process.

Also, regarding a diameter of the flexible glass base plate 1, an identical or slightly larger than a diameter of the brittle member 3 as a protecting object are employed. More specifically, the flexible glass base plate 1 has, preferably, 0.1 to 5 mm larger diameter than a diameter of the brittle member 3, more preferably, 0.5 to 2 mm larger or so. Further, as it will be mentioned as follows, in case that a temporary adhesive means 2 is composed by ultra-violet ray curable adhesive agent, it is preferable that the flexible glass base plate 1 shows a transmissive to ultraviolet ray.

A smaller thickness of the flexible glass base plate 1, the larger maximum curving angle, in the case of an identical material.

A structure body 10 is composed of a brittle member 3 removably fixed via a temporary adhesive means 2 on the above mentioned flexible glass base plate 1. The temporary adhesive means 2 has functions to hold the brittle member 3 on the flexible glass base plate 1 stably and to separate easily. The temporary adhesive means 2 is not particularly limited as far as having said functions, it may be a single layer adhesive film and a double-sided adhesive tape as shown in FIG. 1. For example, the temporary adhesive means 2 may be a single layer adhesive film composed of a weak adhesive agent. Also, it may be a single layer adhesive film composed of an ultra-violet ray curable type adhesive agent. An adhesive force of the ultraviolet ray curable type adhesive agent sharply decreases or disappears by irradiating ultraviolet. Before irradiating the ultraviolet ray, it is possible to hold the brittle member 3 on the flexible glass base plate 1 stably, after irradiating the ultraviolet ray, it is possible to separate easily. The flexible glass base plate 1 used in the present invention is different with a resin plate, and is a transparent and having ultraviolet ray transmissive, when the ultraviolet ray curable type adhesive agent is used, there is no trouble at all.

Also, in view of operating ability and the like, it is particularly preferable that the temporary adhesive means 2 is composed of the double-sided adhesive tape as shown in FIG. 1.

The double-sided adhesive tape 2 is composed of, as shown in FIG. 1, a base material 21 in as a core layer and adhesive layers 22, 23 provided on both side face of the base material. In this case, as the base material positioned as a core layer is not particularly limited, for example, a film composed of polyethylene terephthalate and the like. Also, as the adhesive layers 22, 23 provided on the both side of the base material 21, conventional adhesive agents may be used as far as it is removable. For example, it may be a widely used weak adhesive agent, also, the ultraviolet ray curable type adhesive agent which peeling force can be controlled by irradiating the ultraviolet ray.

The adhesive layers 22, 23 provided on the both side of the base material 21 may be the same, and also the both side may be different materials. For example, any one of the adhesive layer 22, 23 may be composed of the ultraviolet ray curable type adhesive agent, the other may be composed of ultraviolet ray un-curable adhesive agent. If it is composed that, when separating, the adhesive layer 22 which adheres to the brittle member 3 is selected so that a peeling force is smaller than the adhesive layer 23 provided on a side of the flexible glass base plate 1, a process of removing the double-sided adhesive tape 2 from the brittle member 3 becomes unnecessary at the time of separating the flexible glass base plate 1 from the brittle member 3, because the double-sided adhesive tape 2 remains and adheres on the flexible glass base plate 1 side and is separated from the brittle member 3 side without remaining the tape utterly. On the other hand, if it is composed that the adhesive layer 22 which adheres to the flexible glass base plate 1 is selected so that a peeling force is smaller than the adhesive layer 23 provided on a side of the brittle member 3, at the time of separating the flexible glass base plate 3 from the brittle member 3, the double-sided adhesive tape 2 remains and adheres on a surface of the brittle member 3 and is separated without remaining on the side of the flexible glass base plate 1. The tape 2 remaining on the brittle member 3 may be used as a protection membrane for the brittle member 3.

In the structure body 10, the brittle member 3 may be reinforced by further laminating a protection tape and the like on the brittle member 3.

Means for realize the above mentioned structure body 10 is not particularly limited, the brittle member 3 may be adhered on the flexible glass base plate 1 to which the temporary adhesive means 2 is preliminarily adhered, and it may be reverse thereof. In case that the brittle member 3 is a semi-conductor wafer to which circuits are formed on its surface, a circuit face is protected by laminating the circuit face side to the temporary adhesive means 2.

Next, a discretional treatment is performed to the brittle member 3. This treatment is various in accordance with usage of the brittle member 3, and may include various processing treatment, or transportation, storing and the like. For example, in case that the brittle member 3 is a semi-conductor wafer in which circuits are formed on a front surface, a processing treatment is an etching treatment, polishing treatment, sputtering treatment, vapor deposition treatment, grinding treatment to a back face of the wafer. Note that when the treatment applied to the brittle member 3 is storage or transportation, the brittle member 3 may be reinforced by further laminating a protection tape on the brittle member 3, prior to the treatment.

Subsequently, said flexible glass base plate 1 is separated from the brittle member 3. Prior to the separation, as shown in FIG. 1, for preventing deformation of the brittle member 3, the brittle member 3 side is fixed by a holding means 11. The holding means 11 is not particularly limited if it is possible to hold the brittle member 3 without deformation thereof, for example, a suction table or an adhesive tape may be used, and a magnetic material such as an electromagnet can be used depending on material properties of the brittle member.

Figure 3:
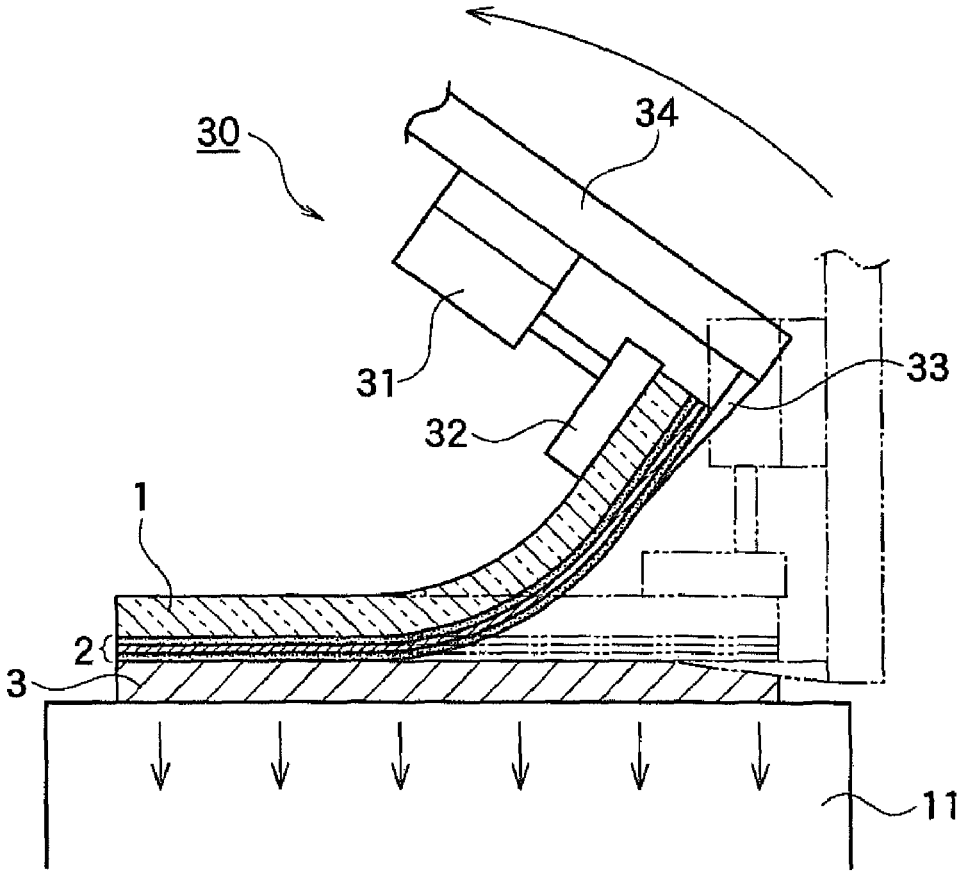
FIG. 3 shows a process for separating a flexible glass base plate by using separating means.
Figure 7:
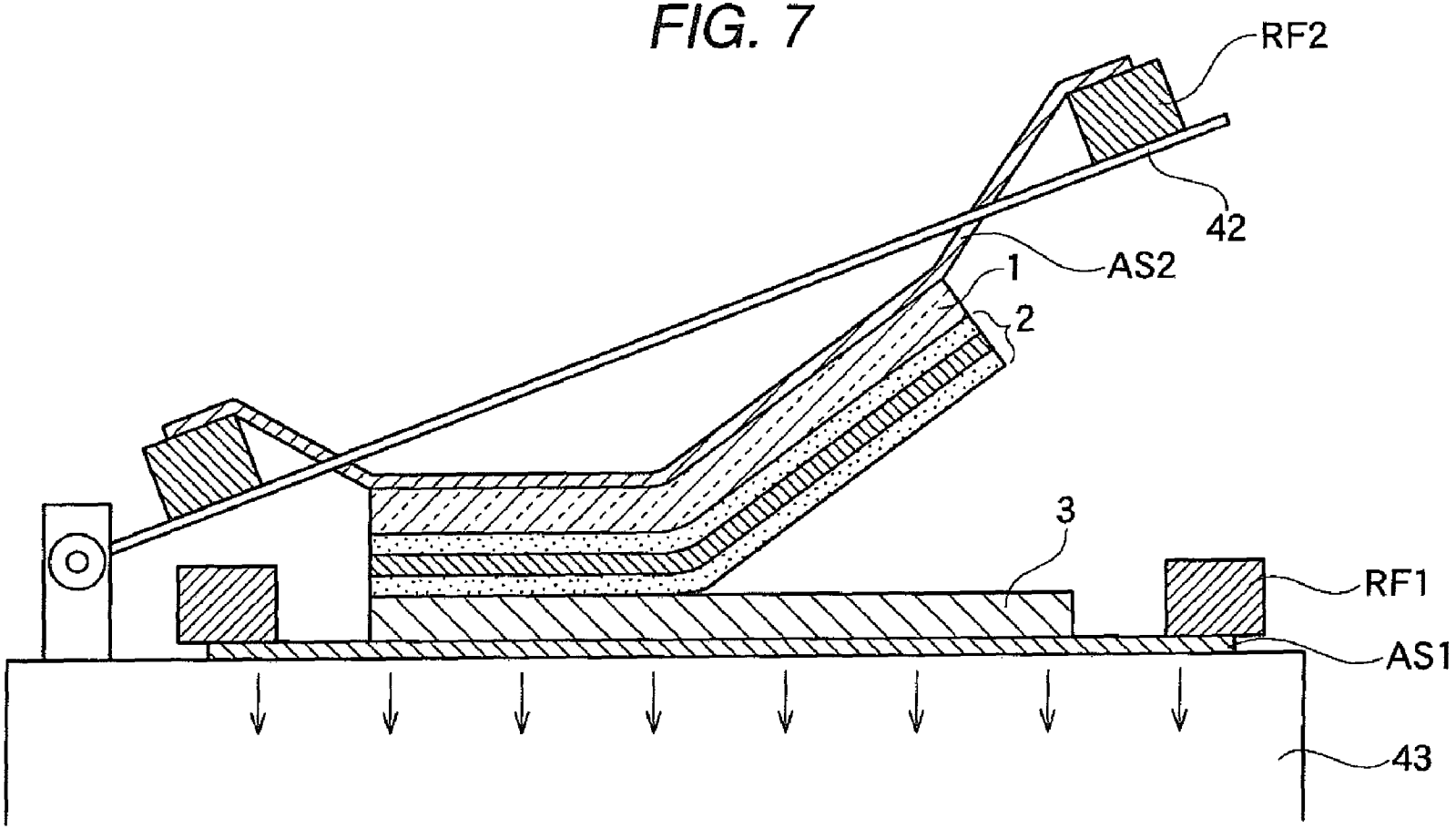
FIG. 7 shows a process for separating a flexible glass base plate by using other aspect of separating means.

Then, the flexible glass base plate 1 is separated while fixing the brittle member 3 by such the holding means 11, as shown in FIG. 3 and FIG. 7. As a result of this, since deformation of the brittle member 3 is prevented, breakage of the brittle member 3 is reduced.

In the present invention, since the flexible glass base plate 1 is used in order to hold the brittle member 3, when separating the brittle member 3 from the flexible glass base plate 1, separation can be conducted by bending the flexible glass base plate 1.

Figure 2:
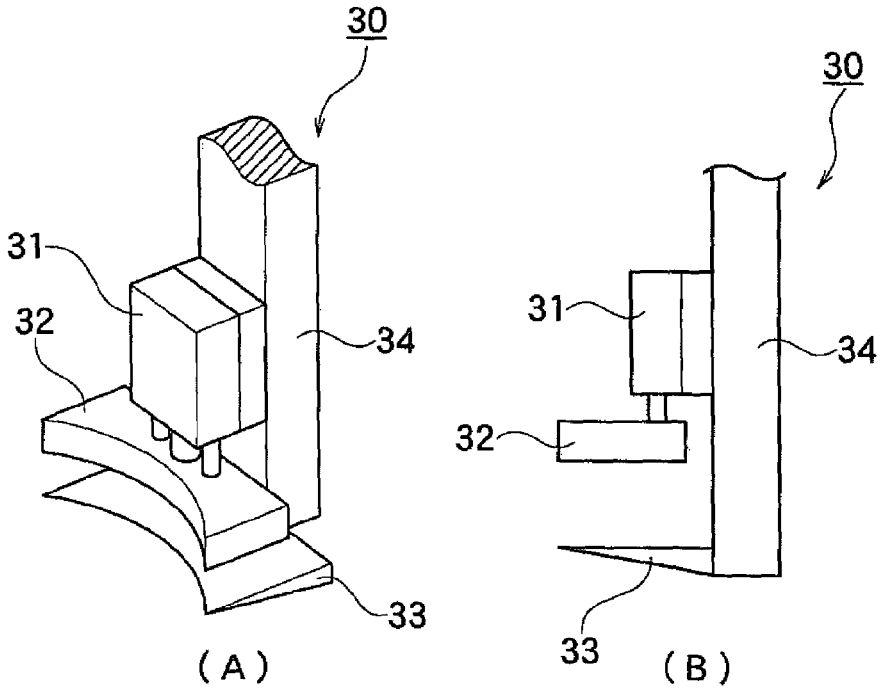
FIG. 2 shows one aspect of separating means.

In order to conduct the separation by bending the flexible glass base plate 1, for example, the separation method may include gripping an end portion of the flexible glass base plate 1, lifting up said end portion from said brittle member 3, and moving towards a turning direction of said flexible glass base plate. Though, the means for gripping the end portion of the flexible glass base plate 1 is not particularly limited, for example, as shown in a perspective view (A) of FIG. 2 and a side view of FIG. 2(B), it is preferably to use separating jigs composed of an upper movable plate 32 held by an air cylinder 31 and the like so that the plate 32 is vertically movable, a lower insertion plate 33 and an axial 34 holding thereof. In the case of using the separating jigs 30, as shown in FIG. 3, the lower insertion plate 33 is inserted between the brittle member 3 and the temporary adhesive means 2, declining the upper movable plate 32, and gripping the end portion of the flexible glass plate 1 by the lower insertion plate 33 and the upper movable plate 32. Then, as shown in FIG. 3, with bending the flexible glass base plate 1 by moving towards a turning direction of said flexible glass base plate 1 with lifting up said end portion from said brittle member 3, separation can be performed. According to this method, since the temporary adhesive means 2 is separated with the flexible glass base plate 1, a process for removing the temporary adhesive means 2 from the brittle member 3 becomes unnecessary. Also, separation of the flexible glass base plate 1 may be operated by inserting the lower insertion plate between the flexible glass base plate 1 and the temporary adhesive means 2. In this case, although the temporary adhesive means 2 remains on the brittle member 3, because the temporary adhesive means is flexible, it is easy to peeling from the brittle member 3.

By removing a holding force of the holding means 11 after separating the flexible glass base plate 1, a brittle member without breakage and contamination is recovered. Note that, for removing the holding force of the holding means 11, for example if the holding means 11 is a suction table, it may be remove suction force, also, in the case of an adhesive tape, it may be peeling this. In the case of magnetic material, by using an electromagnet and the like, the holding force may be removed by disconnecting electric power after finishing required process.

Also, in case that the brittle member 3 is a semi-conductor wafer, a dicing sheet may be used as a holding means 11. By separating the flexible glass base plate with fixing the semi-conductor wafer on the dicing sheet, the semi-conductor wafer is transferred on the dicing sheet. Therefore, transferring to a dicing process which follows the grinding back surface process can be made easily.

Particularly, in the case of transferring the semi-conductor wafer on the dicing sheet, it is preferable to use the following method wherein two ring flames, two adhesive sheets for separating and a transferring device 40 as a separating means are used.

Firstly, two sets of a fixing jig composed of an adhesive sheet (AS) tightly tensioned on a ring flame (RF) are prepared. Then, a laminated body of the flexible glass base plate 1 and the semi-conductor wafer 3 is sandwiched by the two sets of the fixing jigs. Herein after, the fixing jig of the semi-conductor wafer 3 side is referred to as a first fixing jig, a ring flame to compose the first fixing jig is referred to as a first ring flame RF1, an adhesive sheet is referred to as a first adhesive sheet AS1. Similarly, a fixed jig of the flexible glass base plate side 1 is referred to as a second fixing jig, a ring flame to compose the jig is referred to as a second ring flame RF2, an adhesive sheet is referred to as a second adhesive sheet AS2.

Figure 4:
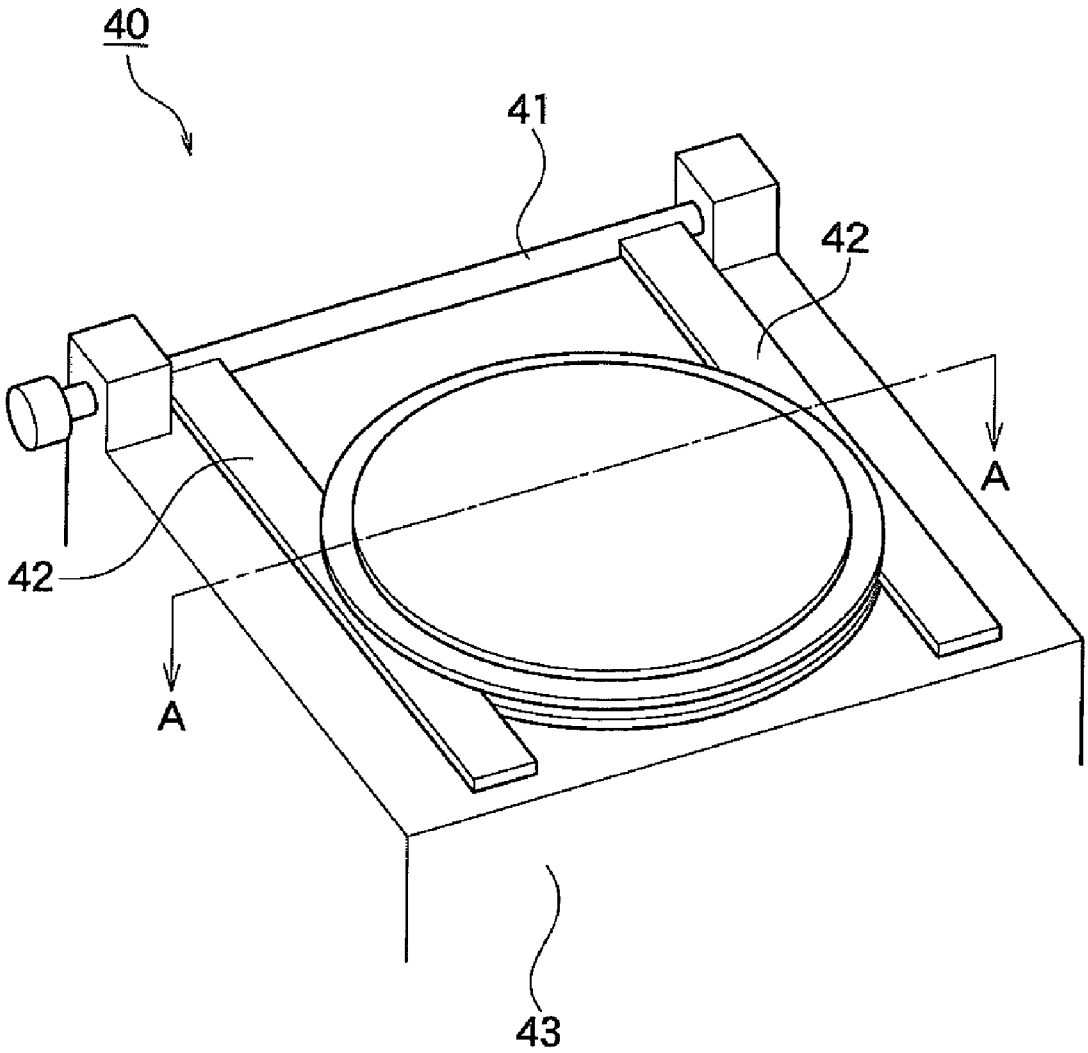
FIG. 4 shows a process for separating a flexible glass base plate by using other aspect of separating means.
Figure 5:
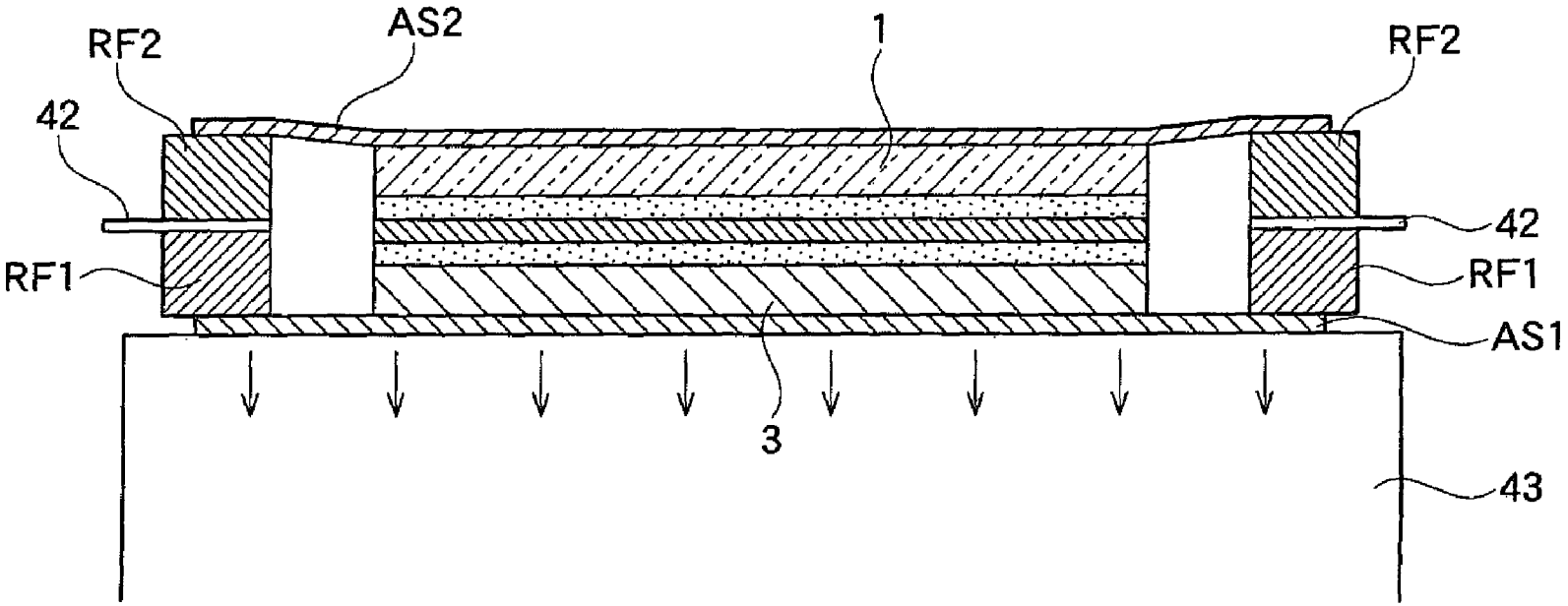
FIG. 5 shows a cross sectional view along a line A-A of FIG. 4.
Figure 6:
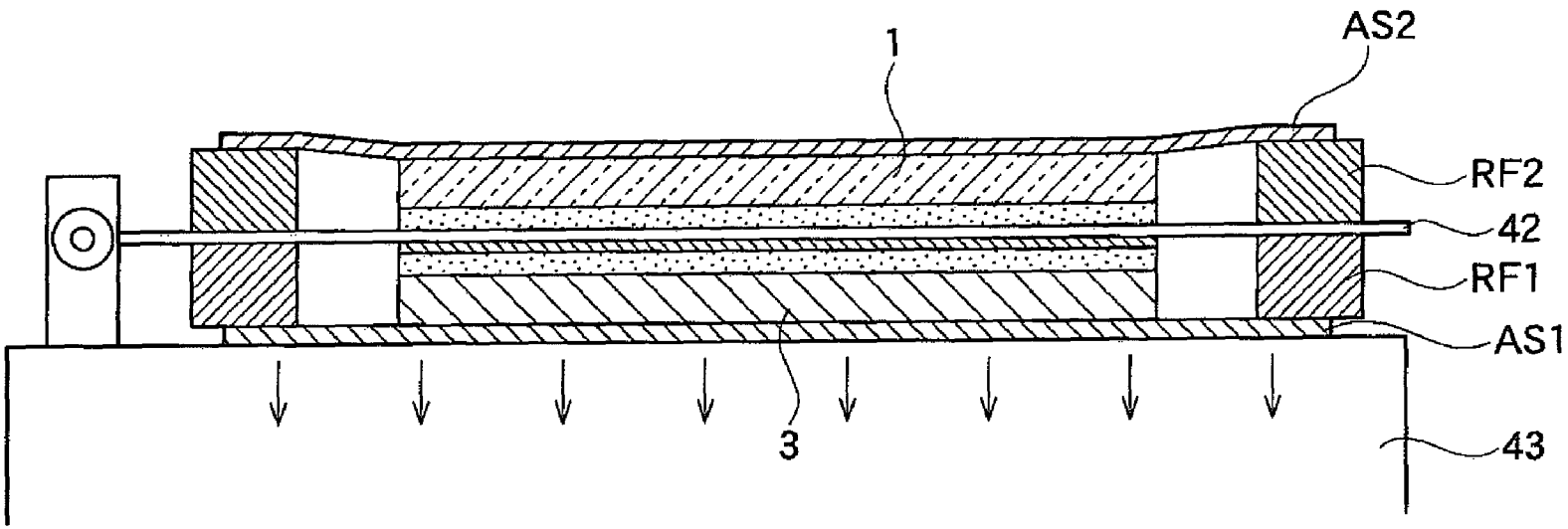
FIG. 6 shows a side view of FIG. 4.

As shown in FIG. 4, a transferring device 40 is composed of a rotary axis 41, a pair of thin plate shape arm 42 equipped to the rotary shaft, and a suction table 43 as a temporary holding means for a processed article. The laminated body of the flexible glass base plate 1 and the semi-conductor wafer 3 sandwiched and hold by the upper and lower two pair of the fixing jigs is set on the above mentioned transferring device 40. At this time, a first fixing jig side is fixed on the suction table 43. Next, the thin plate arms 42 are inserted between the ring flame RF1 and the ring flame RF2. A-A line cross-sectional view of FIG. 4 is shown in FIG. 5, and a side view of FIG. 4 is shown in FIG. 6.

Then, rotating the rotary axis 41 to which the thin plate shape arms 42 are engaged, and enlarging the space between the ring flame RF1 and the ring flame RF2 (FIG. 7). As a result of this, the flexible glass base plate 1 deforms along with a movement of the second fixing jig, and separates with bending from a surface of the semi-conductor wafer 3.

Then, in case that the temporary adhesive means 2 remains on the semi-conductor wafer 3, the temporary adhesive means 2 is peeled and removed from the wafer 3, so that the semi-conductor wafer 3 is transferred on to the first adhesive sheet AS1.

The semi-conductor wafer 3 transferred on the adhesive sheet AS1 tightly tensioned on the ring flame RF1 is recovered to a wafer cassette (not shown), and transferred to a dicing process and the like as a next step. In this case, the adhesive sheet AS1 may be used as a dicing sheet as it is. On the other hand, the flexible glass base plate 1 held on the second fixing jig is separated from the adhesive sheet AS2 and is re-used after washing, removing distortion in accordance with the necessity.

Note that, with respect to the treating method for the brittle member according to the present invention, although it is specified and exemplified to apply the semi-conductor wafer, a constitution and method of the present invention can be applied not only to the semi-conductor wafer, but also variety of brittle members such as glass, ceramics and the like.

INDUSTRIAL APPLICABILITY

In the present invention, because the brittle member is protected with fixing on the flexible glass base plate, the brittle member can be held without deformation when transporting, storing and processing. Also, since it is possible to bend the flexible glass base plate used in the present invention as is different from a conventional rigid glass, when separating the flexible glass base plate from the brittle member, it is possible to separate the brittle member from the glass base plate by deforming the flexible glass base plate side without deforming the brittle member, to thereby preventing breakage of the brittle member.

EXAMPLES

Here, the present invention will be specified by examples, however, the present invention is not limited by these examples.

Note that the maximum curving angle of the flexible glass base plate 1 was measured as follows.

Figure 8:
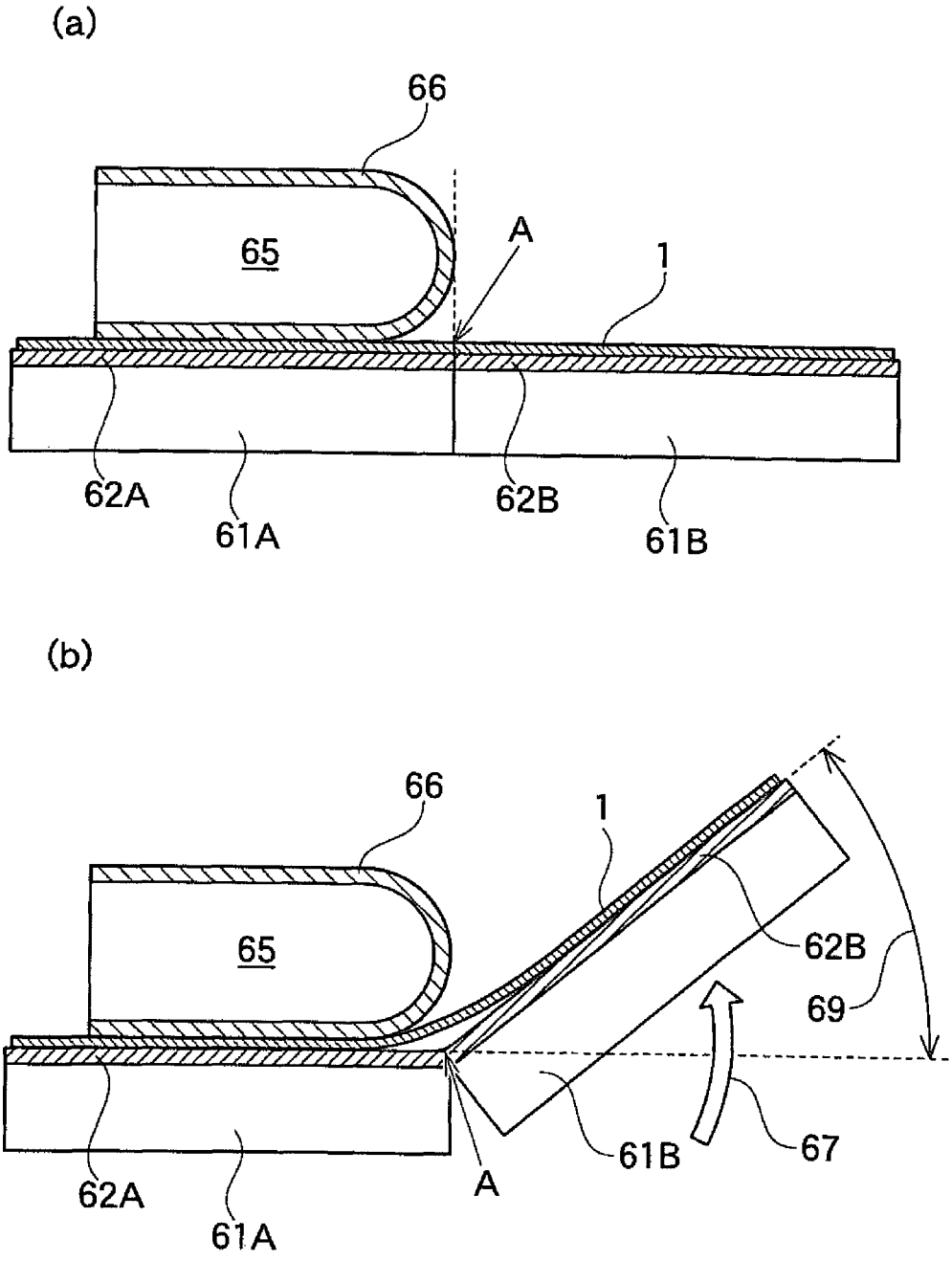
FIG. 8 shows a measuring method for a curving angle of a flexible glass base plate.

FIG. 8 shows a measurement method for a curving angle of the flexible glass base plate. In FIG. 8(*a*), a flexible sheet 62A such as a rubber sheet, a vinyl sheet and the like having 3 mm thickness×200 mm width×250 mm length is laminated on a rigid plate 61A such as a wooden plate, a steel plate and the like having 25 mm thickness×200 mm width×250 mm length. Another rigid plate 61B having same size to which a flexible sheet 62B having same size is laminated was prepared, and faces having size of 28 mm×250 mm of both plates are contacted each other. As an upper end of a contact face is referred to as "A point", a hinge is equipped at jointing of the A point so as to enable a folding movement at the A point as a fulcrum point. Fixing the rigid plate 61A to which the flexible sheet 62A is attached without moving, the rigid plate 61B to which the flexible sheet 62B is attached can be bent at the A point.

And a semi circular cylindrical shape rigid plate 65 having 25 mm thickness×150 mm width×250 mm length is finished as a semi circular cylinder having 250 mm width and 12.5 mm radius. A second flexible sheet 66 having 3 mm thickness×290 mm width×250 mm length is laminated to the semi circular cylindrical shape rigid plate 65, as shown in FIG. 8.

When measuring the curving angle of the flexible glass base plate, the A position is located as it is conformity with a circle center line of the flexible glass base plate. Then, the semi circular cylindrical shape rigid plate 65 to which the above mentioned second flexible sheet 66 is attached, is compressed on the flexible glass base plate without moving the flexible glass base plate. A position, where the flexible glass base plate is compressed by the semi circular cylindrical shape rigid plate 65, is a position where the most outer portion of semi circular cylinder of the second flexible sheet 66 is conformity with the circular center line of the flexible glass base plate.

Next, as shown in FIG. 8(*b*), the rigid plate 61B, to which the flexible sheet 62B is attached, rotates slowly towards an arrow 67 as a fulcrum is the A point. The flexible glass base plate bends towards a circular arc of a lower semi circular cylinder of the semi circular cylindrical shape rigid plate 65 to which the second flexible sheet 66 is attached. A rotation angle towards the arrow 67 direction is performed as about 1 degree/sec curving angle. The curving angle is shown as an angle 69 of an upper face of the flexible sheet 62A and an upper face of the flexible sheet 62B. Then, the maximum curving angle is an angle when the flexible glass base plate is broken with the flexible glass base plate vertically displaces further and further. The angle 69 of the upper face of the flexible sheet 62A and the upper face of the flexible sheet 62B is measured by using a protractor by 1 degree unit.

Also, evaluation for a holding property and separating property are made as follows.

(1) Holding Property

A predetermined flexible glass base plate and an 8-inch silicon wafer (thickness 720 μm) as a brittle member are laminated via double-sided adhesive tape. Subsequently, grinding the silicon wafer until its thickness becomes 50 μm by using a wafer back face grinding machine (produced by DISCO Corporation DFG-840) and as being a constitutional member. A cylindrical plinth having 50 mm height and 50 mm diameter is placed on a flat plate, and further, the ground silicon wafer is positioned on the cylindrical plinth with the flexible glass base plate side is downwardly and a center of the wafer and a center of the base are conformity with. A length from the flat plate to an edge portion of the flexible glass base plate is measured by a scale, and determined that if it is 49 mm to 51 mm is good, and other are NG.

(2) Separating Property

Separating of the flexible glass base plate is performed by using separating means shown in FIG. 3 or FIG. 7. When the semi-conductor wafer side could be separated without breakage and contamination, it was defined as good. When the semi-conductor wafer could not be separated and there were breakage and contamination of the wafer, it was defined as no good.

Example 1

(Manufacturing Double-Sided Adhesive Tape)

As adhesive agents A and B, following adhesive agents are prepared.

Adhesive agent A: adhesive agent composed by mixing 100 parts by weight of copolymer having weight average molecular weight 400,000 obtained by copolymerizing 85 parts by weight of 2-ethylhexylacrylate and 15 parts by weight of 2-hydroxyethylacrylate and cross linking agent composed of 9.4 parts by weight of adduct of tolylene diisocyanate with trimethylolpropane.

Adhesive Agent B: adhesive agent composed by mixing 100 parts by weight of copolymer having weight average molecular weight 500,000 obtained by copolymerizing 80 parts by weight of butylacrylate and 10 parts by weight of methylmethacrylate and 5 parts by weight of 2-hydroxyethylacrylate and cross linking agent composed of 0.9 parts by weight of adduct of tolylene diisocyanate with trimethylolpropane.

To a polyethylene terephthalate (PET) film having thickness of 50 μm, the adhesive agent A was coated and dried so that its dry thickness becomes 20 μm by using a roll coater, and laminated with a release film. Subsequently, to another release film, the adhesive agent B was coated and dried so that its dry thickness becomes 20 μm, and thereby obtaining a double-sided adhesive tape by laminating the adhesive layer B to the opposite face PET film where the adhesive agent A is not coated.

(Manufacturing Flexible Glass Base Plate)

Material mixture of glass composed of $SiO_2$ 63 wt %, $Al_2O_3$ 14 wt %, $Li_2O$ 6 wt %, $Na_2O$ 10 wt %, $ZrO_2$ 7 wt % was heated for 5 hours at 1500 to 1600° C. to melt, the molten liquid was casted on a steel plate and pressed, and a glass plate was obtained. Next, the glass plate was cut to be desired size and polished, and a circular glass plate having diameter of 201 mm and thickness of 0.5 mm was obtained. Subsequently, the glass plate was dipped into 360° C. of molten salt mixture of $KNO_3$: 60%, $NaNO_3$: 40% for three hours to perform ion-exchanging of the glass surface portion, and a chemically reinforced flexible glass base plate A having compression stress layer of 100 μm was obtained. The maximum curving angle of the glass was about 40 degree.

(Manufacturing Constitutional Member)

The flexible glass base plate A and 8-inch silicon wafer having thickness of 720 μm are laminated under vacuum, via the double-sided adhesive sheet wherein release films on the both faces are removed. Then, the silicon wafer was ground until its thickness becomes 50 μm by using a wafer back face grinding machine (produced by DISCO Corporation DFG-840) and the flexible glass base plate A was separated from the wafer by using the separating means shown in FIG. 3. Evaluation is made for holding property and separating property of this constitutional member. The holding and separating properties were good.

Example 2

A similar operation as in the above example 1 was conducted except for separating the flexible glass base plate by using separating means shown in FIG. 7. The holding and separating properties were good.

Example 3

(Manufacturing Flexible Glass Base Plate)

Material mixture of glass having the same composition ratio as in the example 1 was heated for 5 hours at 1500 to 1600° C. to melt, the molten liquid was casted on a steel plate and pressing, a glass plate was obtained. Next, the glass plate was cut to be desired size and polished, and a circular glass plate having diameter of 201 mm and thickness of 1 mm was obtained. Subsequently, the glass plate was dipped into 360° C. of molten salt mixture of $KNO_3$:60%, $NaNO_3$:40% for three hours to perform ion-exchanging of the glass surface portion, and a chemically reinforced flexible glass base plate B having compression stress layer of 100 μm was obtained. The maximum curving angle of the glass was about 32 degree. A similar operation as in the above example 2 was conducted except for separating the flexible glass base plate B by using separating means shown in FIG. 7. The holding and separating properties were good.

The invention claimed is:

1. A treating method for brittle member comprising:

a step of providing a flexible glass base plate that has a curving angle of 30 degrees up to a maximum curving angle, said maximum curving angle being an angle tangent to a maximum bending angle of the flexible glass base plate immediately before breaking, a step of removably fixing a brittle member on said flexible glass base plate, a step of treating said brittle member, a step of fixing said brittle member side by holding means, and a step of separating said flexible glass base plate from said brittle member by bending said flexible glass base plate away from the brittle member without deforming the brittle member.

2. The treating method as set forth in claim 1, wherein an outer diameter of said flexible glass plate is an identical with or larger than an outer diameter of said brittle member.

3. The treating method as set forth in claim 1, wherein said flexible glass plate curves at an angle between 30 to 50 degrees.

4. The treating method as set forth in claim 1, wherein said separating process compromises gripping end portion of said flexible glass base plate, lifting up said end portion from said brittle member, and moving towards a turning direction of said flexible glass base plate.

5. The treating method as set forth in claim 1, wherein said separating process comprising, applying a first adhesive sheet tightly tensioned on a first ring frame to said brittle member, applying a second adhesive sheet tightly tensioned on a second ring frame to said flexible glass base plate, fixing a first adhesive sheet side on a suction table, enlarging the space between said first ring frame and said second ring frame to thereby separating the flexible glass base plate from a surface of the brittle member by bending the flexible glass base plate applying on the second adhesive sheet.

6. The treating method as set forth in claim 1, wherein, said brittle member is a semi-conductor wafer.

7. The treating method as set forth in claim 6, wherein the treatment applied to the brittle member is a grinding back surface of the semi-conductor wafer.

8. The treating method as set forth in claim 2, wherein, said brittle member is a semi-conductor wafer.

9. The treating method as set forth in claim 3, wherein, said brittle member is a semi-conductor wafer.

10. The treating method as set forth in claim 4, wherein, said brittle member is a semi-conductor wafer.

11. The treating method as set forth in claim 5, wherein, said brittle member is a semi-conductor wafer.

12. The treating method as set forth in claim 8, wherein the treatment applied to the brittle member is a grinding back surface of the semi-conductor wafer.

13. The treating method as set forth in claim 9, wherein the treatment applied to the brittle member is a grinding back surface of the semi-conductor wafer.

14. The treating method as set forth in claim 10, wherein the treatment applied to the brittle member is a grinding back surface of the semi-conductor wafer.

15. The treating method as set forth in claim 11, wherein the treatment applied to the brittle member is a grinding back surface of the semi-conductor wafer.

16. The treating method as set forth in claim 1, wherein said flexible glass base plate has a thickness of 300 to 1500 μm, and has a chemically strengthened compression stress layer obtained by ion exchange treatment with Na ion and/or K ion.

17. The treating method as set forth in claim 16, wherein said compression stress layer of the flexible glass base plate is obtained by ion exchange treatment with at least K ion.

18. The treating method as set forth in claim 16, wherein said compression stress layer of the flexible glass base plate has a thickness of about 100 μm.

19. The treating method as set forth in claim 5, wherein said flexible glass base plate has a thickness of 300 to 1500 μm, and has a chemically strengthened compression stress layer obtained by ion exchange treatment with Na ion and/or K ion.

20. The treating method as set forth in claim 19, wherein said compression stress layer of the flexible glass base plate is obtained by ion exchange treatment with at least K ion.

21. The treating method as set forth in claim 19, wherein said compression stress layer of the flexible gas base plate has a thickness of about 100 μm.

* * * * *